US010468162B2

(12) United States Patent
Ma et al.

(10) Patent No.: US 10,468,162 B2
(45) Date of Patent: Nov. 5, 2019

(54) INSULATION PIPE AND INSULATION SLEEVE WITH SUCH INSULATION PIPE

(71) Applicant: JIANGSU SHEMAR ELECTRIC CO., LTD., Nantong (CN)

(72) Inventors: Bin Ma, Nantong (CN); Jiang Fang, Nantong (CN); Libin Yang, Nantong (CN)

(73) Assignee: JIANGSU SHEMAR ELECTRIC CO., LTD., Nantong (CN)

( * ) Notice: Subject to any disclaimer, the term of this patent is extended or adjusted under 35 U.S.C. 154(b) by 21 days.

(21) Appl. No.: 15/751,390

(22) PCT Filed: Aug. 10, 2016

(86) PCT No.: PCT/CN2016/094406

§ 371 (c)(1),
(2) Date: Jul. 2, 2018

(87) PCT Pub. No.: WO2017/025036

PCT Pub. Date: Feb. 16, 2017

(65) Prior Publication Data

US 2018/0301251 A1 Oct. 18, 2018

(30) Foreign Application Priority Data

Aug. 11, 2015 (CN) ..... 2015 1 0489210

(51) Int. Cl.
*H01B 17/56* (2006.01)
*H01B 17/38* (2006.01)
(Continued)

(52) U.S. Cl.
CPC ..... *H01B 17/38* (2013.01); *H01B 17/325* (2013.01); *H01B 17/34* (2013.01); *H01B 17/583* (2013.01); *H01B 17/66* (2013.01); *H01B 17/28* (2013.01)

(58) Field of Classification Search
CPC ..... H01B 17/38; H01B 17/325; H01B 17/34; H01B 17/583; H01B 17/66; H01B 17/28; H01B 17/303; H01B 17/30; H01B 17/301
(Continued)

(56) References Cited

U.S. PATENT DOCUMENTS 3,883,680 A * 5/1975 Keen, Jr. ..... H01B 17/34 174/12 BH
4,609,775 A * 9/1986 Moran ..... H01B 17/34 174/152 R
(Continued)

FOREIGN PATENT DOCUMENTS

CN 2243114 Y 12/1996
CN 101123132 A 2/2008
(Continued)

OTHER PUBLICATIONS

International Search Report (and English Translation thereof) and Written Opinion for Application No. PCT/CN2016/094406 dated Nov. 4, 2016.
(Continued)

*Primary Examiner* — Angel R Estrada
(74) *Attorney, Agent, or Firm* — Kagan Binder, PLLC

(57) ABSTRACT

Disclosed are an insulated pipe and an insulated bushing. The insulated bushing (1000) includes: an insulator (110) including an intermediate shed member (112), and a lower flange (114) arranged on a lower end of the shed member; a head member (120) connected to an upper end of the insulator, wherein the head member includes an oil conservator (121) connected to the upper end of the insulator and a connecting terminal (122) connected to the oil conservator; and an insulated pipe (100) connected to the lower flange, wherein the insulated pipe includes a upper transformer pipe (101) and a lower oil-immersed pipe (102), and the transformer pipe includes an inner pipe (103), and a conductive
(Continued)

layer arranged outside the inner pipe and configured to be grounded. The insulated pipe and the insulated bushing solve the problems of connection and sealing, and save material cost greatly.

9 Claims, 4 Drawing Sheets

(51) Int. Cl.

| | |
|---|---|
| ***H01B 17/58*** | (2006.01) |
| ***H01B 17/66*** | (2006.01) |
| ***H01B 17/32*** | (2006.01) |
| ***H01B 17/34*** | (2006.01) |
| *H01B 17/28* | (2006.01) |

(58) Field of Classification Search
USPC .... 174/152 R, 140 R, 142, 144, 650, 11 BH, 174/14 BH, 137 R, 138 R; 16/2.1, 2.2
See application file for complete search history.

(56) References Cited

U.S. PATENT DOCUMENTS

| | | | | |
|---|---|---|---|---|
| 7,964,799 | B2 * | 6/2011 | Isberg | H01B 17/303 174/152 R |
| 8,003,891 | B2 * | 8/2011 | Rocks | H01B 17/28 174/152 R |
| 8,637,773 | B2 * | 1/2014 | Jonsson | B29C 70/58 174/137 B |
| 8,969,729 | B2 * | 3/2015 | Jahnel | H01B 17/42 174/142 |
| 2002/0029899 | A1 | 3/2002 | Wilson et al. | |

FOREIGN PATENT DOCUMENTS

| | | | |
|---|---|---|---|
| CN | 201689761 | U | 12/2010 |
| CN | 102568696 | A | 7/2012 |
| CN | 103456473 | A | 12/2013 |
| CN | 203415386 | U | 1/2014 |
| CN | 203941765 | U | 11/2014 |
| CN | 105139978 | A | 12/2015 |
| CN | 205211506 | U | 5/2016 |
| GB | 253189 | A | 6/1926 |
| GB | 778560 | A | 7/1957 |
| JP | 2011083133 | A | 4/2011 |

OTHER PUBLICATIONS

Search Report & First Office Action and English Translation thereof for Priority Chinese Patent Application No. 201510489210.6, dated Jul. 4, 2016.

Supplementary Search Report & Second Office Action and English Translation thereof for Priority Chinese Patent Application No. 201510489210.6, dated Feb. 7, 2017.

Third Office Action and English Translation thereof for Priority Chinese Patent Application No. 201510489210.6, dated Jun. 19, 2017.

Fourth Office Action and English Translation thereof for Priority Chinese Patent Application No. 201510489210.6, dated Dec. 4, 2017.

Extended European Search Report for the Counterpart European Application No. 16834660.9 dated Feb. 14, 2019, (22 pages).

* cited by examiner

INSULATION PIPE AND INSULATION SLEEVE WITH SUCH INSULATION PIPE

TECHNICAL FIELD

The present disclosure relates to a power transmission device, and more particularly, to an insulated pipe and an insulated bushing with such insulted pipe.

BACKGROUND

The insulated bushing in the power transmission device serves as a connection component between a power transmission and transformation device and an external line. The voltage level and the working current of the insulated bushing depend on the rated voltage and current values of the power transmission and transformation device. In addition, the insulated bushing should be structured to have good electrical performance and sufficient mechanical strength to secure a long-term normal operation of the power transmission and transformation device.

The insulated bushing includes an insulator, a transformer pipe disposed at a lower end of the insulator, and an oil-immersed pipe disposed inside the power transmission and transformation device. The transformer pipe is configured to be fitted with a transformer coil. The transformer pipe in the prior art is an aluminum-alloy pipe, and the oil-immersed pipe is a porcelain pipe. The insulator, the transformer pipe and the oil-immersed pipe are generally connected together in a spring pressed-form, with a strong spring cooperated with an electrical conductor to provide a connection force in a range between 25 KN and 70 KN. Sealing grooves are provided at the lower end of the insulator and on the transformer pipe, which are sealed with O-shaped sealing rings. Such connection configuration is quite complex in structure, relies on manual assembly, and is impossible to be manufactured automatically, so it is inefficient. In addition, there is a sealing risk due to the sealing of many portions with the sealing rings. The transformer pipe and the oil-immersed pipe should have a consistent wall thickness, so the transformer pipe has a large wall thickness, which wastes materials to make material cost higher.

SUMMARY

In order to address the defects in the prior art, an objective of the present disclosure is to provide an insulated pipe, which solves problems of the transformer pipe in connection and material cost.

To achieve the above-mentioned objective, the present disclosure provides an insulated pipe, used for an insulated bushing. The insulated bushing includes: an insulator including an intermediate shed member and a lower flange arranged at a lower end of the shed member; a head member, including an oil conservator connected to an upper end of the insulator and a connecting terminal connected to the oil conservator; and the insulated pipe, connected to the lower flange, the insulated pipe including a upper transformer pipe and a lower oil-immersed pipe, wherein the transformer pipe includes an inner pipe, and a conductive layer arranged outside the inner pipe and configured to be grounded.

For the above insulated pipe, since the transformer pipe is divided into an inner pipe with no requirement on electrical conductivity, and a conductive layer outside the inner pipe, so the inner pipe can be made of a material equal to or similar to the material of the oil-immersed pipe at the lower end of the inner pipe. The freedom of choice of the material of the inner pipe can allow the connection between the inner pipe and the oil-immersed pipe to be implemented easily. For the connection between the transformer pipe made of an aluminum-alloy material and the oil-immersed pipe in the prior art, since the oil-immersed pipe is unable to be made of the aluminum-alloy material, it is difficult to implement connection and seal between the transformer pipe and the oil-immersed pipe. By contrast, the design of the inner pipe of the present disclosure solves these problems in connection and sealing perfectly. In addition, since the conductive layer is responsible for the conductive function, the freedom of choice of the material of the inner pipe allows the inner pipe to be made of a material with a cost much lower than the aluminum-alloy material, to significantly reduce the material cost of the transformer pipe.

Preferably, the above inner pipe and the above oil-immersed pipe are molded in one body. The above inner pipe and the oil-immersed pipe can be made of a same material, and molded in one body, so that there is no addition connection between the inner pipe and the oil-immersed pipe, which secures the sealing effect effectively.

Preferably, the above inner pipe and the above oil-immersed pipe are molded by means of fiber winding. The fiber may be glass fiber or aramid fiber. The inner pipe and the oil-immersed pipe may be molded by means of resin-impregnated fiber winding, i.e., by wet winding. The inner pipe and the oil-immersed pipe may be molded by means of dry winding, i.e., by fiber winding, resin casting, and curing. The insulated pipe manufactured by the above-mentioned processes has a better anti-vibration performance than the porcelain pipe in the prior art, so it is not subject to brittle failure. And the insulated pipe is easy to be connected to other members. The manufacturing technique according to the present disclosure is simpler in manufacture than the porcelain technique in the prior art, so as to save time cost.

More preferably, the above insulator further includes an inner core cylinder supporting the above shed member, the inner core cylinder is molded by means of fiber winding, and the inner core cylinder and the inner pipe are molded in one body. Since the inner core cylinder and the inner pipe are molded in one body, it avoids assembling the flange and the inner pipe again in the assembly, and there is no requirement to use a sealing component, such as sealing ring to seal the interface between the flange and the inner pipe, which secures the sealing performance of the insulated bushing. More preferably, the inner core cylinder, the inner pipe and the above oil-immersed pipe are molded in one body. The three components molded in one body further secures the sealing performance of the insulated bushing, while there is no requirement of additional assembling, which improves the integrity of the insulated bushing, and avoids damage caused by external force applied in mounting locations among these components.

Preferably, the above conductive layer is configured to be grounded through the above lower flange. Since the lower flange is generally connected to the housing of the device, the conductive layer can be grounded only by connecting the conductive layer to the lower flange electrically. The conductive layer is grounded so that the conductive layer keeps zero potential to effectively prevent the transformer coil arranged outside the conductive layer from being disturbed by partial discharge or electrical particles inside the conductive layer.

Preferably, the above conductive layer is a metal cylinder. The metal cylinder is arranged outside the inner pipe, and an upper end of the metal cylinder is fastened to the above lower flange through a screw, and is grounded through the lower flange. The metal cylinder is only required to have a appropriate thickness that satisfies the conductive performance of the transformer pipe, which saves the material cost greatly, compared with the transformer pipe with a same wall thickness as the oil-immersed pipe in the prior art. In addition, there is a low requirement on the mechanical performance of the metal cylinder since the inner pipe plays a supporting role. Further, it is only required to connect the metal cylinder to the lower flange to prevent the metal cylinder from falling off, and to keep good electrical conductivity, without any sealing connection. The arrangement of the metal cylinder allows the insulated pipe to have a simple structure, and to be easy to assemble, and reduces cost greatly.

Preferably, the above conductive layer is conductive paint coated on an outer surface of the inner pipe. The portion of the inner pipe which is coated with the conductive paint may be connected to the flange or other members through a lead wire so as to be grounded. Relative to the arrangement of the metal cylinder in the previous embodiment, the arrangement of the conductive paint further saves materials and reduces cost, and it decreases the structure complexity of the insulated bushing, while having all functions of the above metal cylinder.

Preferably, the above insulated pipe is provided with an inside liner inside the insulated pipe. This inside liner can prevent the insulated pipe from being corroded by the oil in the device, and avoid the pollution to the oil produced by the corroded dissolved matter.

Preferably, an outer surface of the insulated pipe is coated with insulating paint. This insulating paint can avoid corrosion caused by the outer surface of the insulated pipe contacting with the oil in the device, and avoid the pollution to the oil produced by the corroded dissolved matter.

In order to address the defects in the prior art, another objective of the present disclosure is to provide an insulated bushing, which solves problems of the transformer pipe in connection and material cost.

To achieve the above-mentioned objective, the present disclosure provides an insulated bushing, including: an insulator including an intermediate shed member and a lower flange arranged at a lower end of the shed member; a head member including an oil conservator connected to an upper end of the insulator and a connecting terminal connected to the oil conservator; and an insulated pipe connected to the lower flange. The insulated pipe can be any type of the above insulated pipes according to the present disclosure.

For the above insulated bushing, since the transformer pipe is divided into an inner pipe with no requirement on electrical conductivity, and a conductive layer outside the inner pipe, so the inner pipe can be made of a material equal to or similar to the material of the oil-immersed pipe at the lower end of the inner pipe. The freedom of choice of the material of the inner pipe can allow the connection between the inner pipe and the oil-immersed pipe to be implemented easily. For the connection between the transformer pipe made of an aluminum-alloy material and the oil-immersed pipe in the prior art, since the oil-immersed pipe is unable to be made of the aluminum-alloy material, it is difficult to implement connection and seal between the transformer pipe and the oil-immersed pipe. By contrast, the design of the inner pipe of the present disclosure solves these problems in connection and sealing perfectly. In addition, since the conductive layer is responsible for the conductive function, the freedom of choice of the material of the inner pipe allows the inner pipe to be made of a material with a cost much lower than the aluminum-alloy material, to significantly reduce the material cost of the transformer pipe.

BRIEF DESCRIPTION OF THE DRAWINGS

FIG. 4 shows a half-sectional view of an insulated pipe 300 with a part of an insulator according to a third embodiment of the present disclosure, wherein:

1000—insulated bushing;
1001—conductor;
1002—capacitor core;
100, 200, 300—insulated pipe;
101, 201, 301—transformer pipe;
102, 202. 302—oil-immersed pipe;
103. 203, 303—inner pipe;
104, 304—metal cylinder;
204—conductive paint;
105, 205, 305—lower terminal;
106, 206—voltage equalizing ball;
107—connection member;
207—wire;
110, 310—insulator;
111, 311—inner core cylinder;
112, 312—shed member;
113—upper flange;
114, 214, 314—lower flange;
120—head member;
121—oil conservator; and
122—connecting terminal.

DETAILED DESCRIPTION OF THE EMBODIMENTS

According to requirements, specific embodiments of the present disclosure will be revealed herein. However, those skilled in the art would appreciate that the embodiments revealed herein are only exemplary examples and the present disclosure may take various forms. Hence, specific details revealed herein are not regarded as limiting the present invention, but only regarded as a basis of claims and a basis for teaching those skilled in the art to apply the present disclosure differently in any appropriate mode, including employment of various features disclosed and combination of features that might not be explicitly disclosed.

First Embodiment

Figure 1:
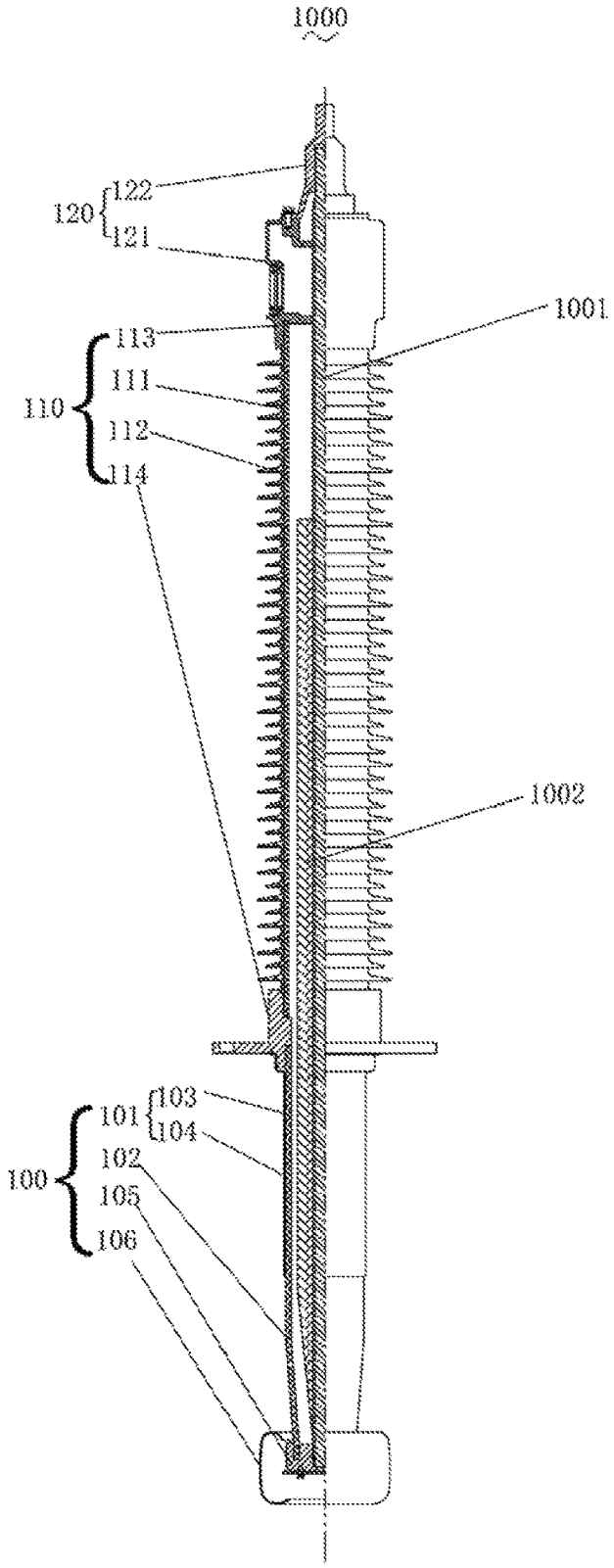
FIG. 1 shows a half-sectional view of an insulated bushing 1000 according to a first embodiment of the present disclosure.
Figure 2:
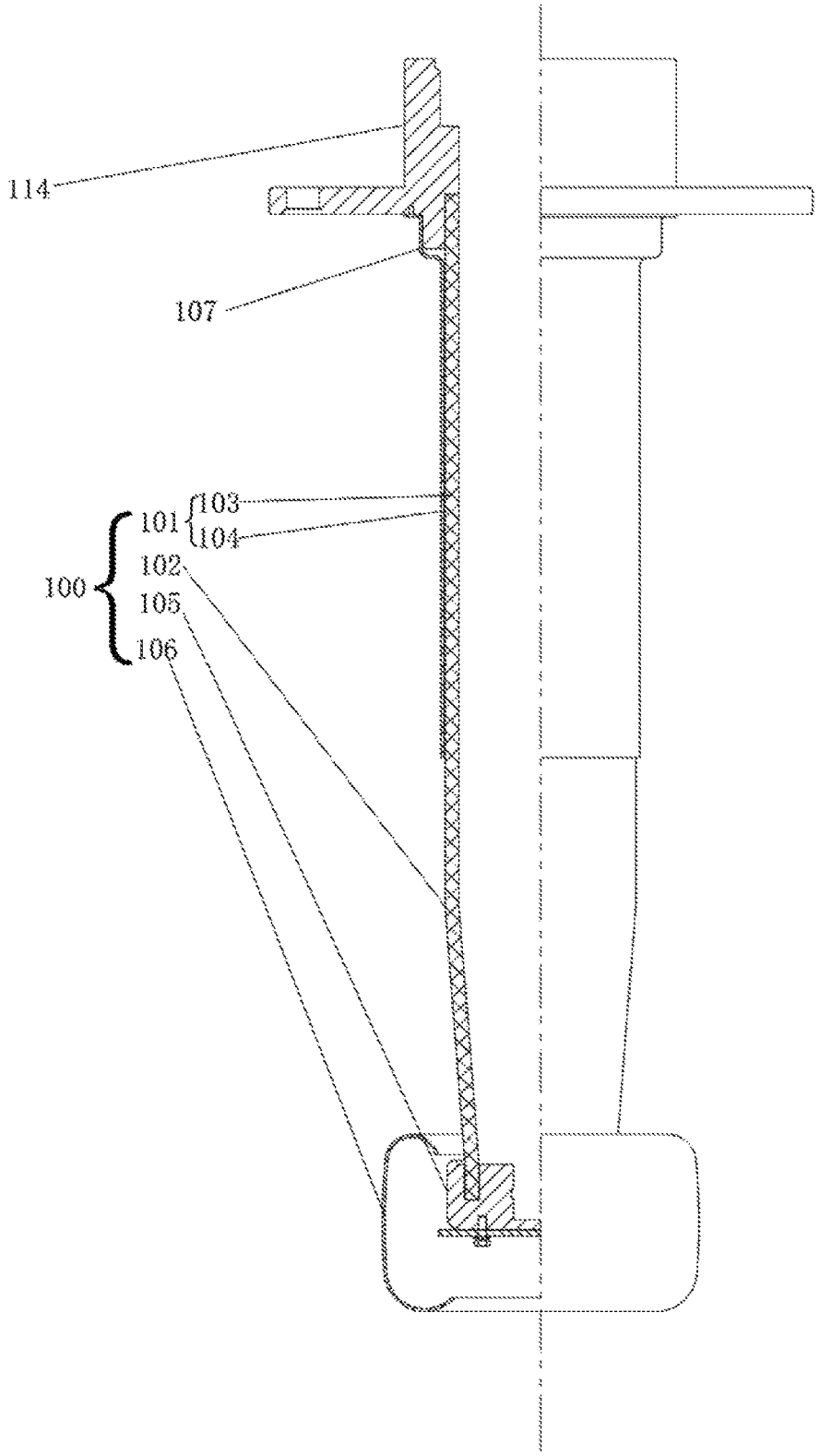
FIG. 2 shows a half-sectional view of an insulated pipe 100 with a lower flange 114 according to the first embodiment of the present disclosure.

As shown in FIG. 1 and FIG. 2, an insulated bushing 1000 in this embodiment includes an insulator 110, a head member 120 connected to a upper end of the insulator and an insulated pipe 100 connected to a lower end of the insulator 110.

The insulator 110 includes an inner core cylinder 111, a shed member 112 covering the inner core cylinder 111, an upper flange 113 connected to a upper end of the shed member 112 and a lower flange 114 connected to a lower end of the shed member 112. The inner core cylinder 111 is a hollow pipe made of a glass fiber reinforced plastic material, which may be molded by epoxy resin-impregnated glass fiber winding and curing. In addition, those skilled in the art may manufacture the inner core cylinder 111 with other fibers, such like aramid fiber, by means of mould pressing or other processes according to actual situations. The shed member 112 is molded in one body from silicone rubber through vacuum infusion molding. Both of the upper flange 113 and the lower flange 114 are metal flanges, and in this embodiment, both of the upper flange 113 and the lower flange 114 are made of an aluminum-alloy material. In addition, both of the upper flange 113 and the lower flange 114 may also be made of other metal materials such as iron. The insulator 110 in this embodiment is a composite insulator, but those skilled in the art may choice a porcelain insulator or other types of insulators according to actual demands.

The head member 120 includes an oil conservator 121 connected to the upper flange 113 and a connecting terminal 122 connected to the oil conservator 121. An oil level of the oil in the insulated bushing 1000, where the oil arrives at the oil conservator 121, can be monitored by the oil conservator 121. The connecting terminal 122 is configured to lead a wire in the device out, which is connected to the other external devices in turn. The connecting terminal 122 in this embodiment is made of a copper material.

The insulated pipe 100 includes an upper transformer pipe 101 and a lower oil-immersed pipe 102. The transformer pipe 101 includes an inner pipe 103 and a metal cylinder 104 arranged outside the inner pipe 103. A lower end of the oil-immersed pipe 102 is connected to a lower terminal 105, and a voltage equalizing ball 106 is arranged outside the lower terminal 105. Both of the inner pipe 103 and the oil-immersed pipe 102 are molded in one body with a glass fiber reinforced plastic material. Both of the inner pipe 103 and the oil-immersed pipe 102 in this embodiment are molded by epoxy resin-impregnated glass fiber winding. In addition, the inner pipe 103 and the oil-immersed pipe 102 may also be molded by die casting or other appropriate molding processes. In this embodiment, the conductive layer is a metal cylinder 104 made of an aluminum-alloy material, but the metal cylinder 104 may be also made of other materials according to actual situations in practical applications. The thickness of the metal cylinder 104 is 2 mm. In this embodiment, the lower terminal 105 is made of an aluminum-alloy material, and the voltage equalizing ball 106 is also made of an aluminum-alloy material. The voltage equalizing ball 106 is fastened to the lower terminal 105 through an internal bolt. An upper end of the metal cylinder 104 is provided with a connection member 107. The shape of the connection member 107 fits the shape of a lower end of the lower flange 114. An end of the connection member 107 fits closely with a surface of the lower flange 114, and the metal cylinder 104 is fastened to the lower flange 114 through a bolt. The connection member 107 is electrically connected to the lower flange 114 to allow the metal cylinder 104 to be grounded through the lower flange 114. A upper end of the inner pipe 103 is connected to the lower flange 114 in a bonding manner. The lower terminal 105 is connected to a lower end of the oil-immersed pipe 102 in a bonding manner.

The insulated bushing 1000 further includes a conductor 1001 and a capacitor core 1002. The conductor 1001 is a cylindrical conductor, typically made of an aluminum-alloy material, but may also be made of other metals such like copper. The conductor 1001 may be a solid cylinder, but may also be a hollow pipe. An upper end of the conductor 1001 is connected to the connecting terminal 122, and a lower end of the conductor 1001 is connected to the lower terminal 105. A layered capacitor core 1002 is also provided inside the inner core cylinder 111 and the insulated pipe 100 outside the conductor 1001. The wire led from the outermost layer of the capacitor core 1002 is grounded. Moreover, a cavity formed in the middle portion of the insulated bushing 1000 is filled with oil (not shown) in the applied device. The oil level of the oil arrives at a position within the oil conservator 121, and both of the capacitor core 1002 and the conductor 1001 are immersed in the oil. The insulted bushing 1000 in this embodiment may serve as a lead-out bushing for a transformer or reactor.

An inside liner (not shown) is also provided inside the insulated pipe 100. The inside liner is made of polyester, and configured to prevent the oil from corroding the inner pipe 103 and the oil-immersed pipe 102 both of which are made of a glass fiber reinforced plastic material, and in turn to avoid the oil from being polluted by the dissolved product from the glass fiber reinforced plastic material. The oil-immersed pipe 102 is also coated with insulating paint (not shown) that is epoxy paint or polyurethane, which can also avoid the oil-immersed pipe 102 made of the glass fiber reinforced plastic material from being corroded by the oil, and avoid the oil from being polluted by the dissolved product of the glass fiber reinforced plastic material.

For the insulated bushing 1000 in this embodiment, since transformer pipe 101 is divided into an inner pipe 103 and a metal cylinder 104 outside the inner pipe 103, the material of the inner pipe 103 is selectable, to facilitate the connection to the oil-immersed pipe 102, and to have a good sealing effect. The conductive layer, i.e. the metal cylinder 104 in this embodiment, is only required to have a conductive shielding function, thus the metal cylinder 104 can be very thin such that this embodiment saves the materials of the metal cylinder 104 greatly and decreases the material cost compared with the metal cylinder in the prior art that has the same thickness as the oil-immersed pipe.

Further, this embodiment allows the inner pipe 103 to be made of the same material as the oil-immersed pipe 102, and the inner pipe 103 and the oil-immersed pipe 102 are molded in one body, so there is no connection problem between the transformer pipe 101 and the oil-immersed pipe 102, and there is no requirement on sealing treatment applied at the connection between the transformer pipe 101 and the oil-immersed pipe 102. A metal cylinder 104 with a thickness of only 2 mm can serve as a conductive portion of the transformer pipe 101, such that the embodiment saves the material cost of the transformer pipe 101 compared with the prior art that the thickness of the aluminum-alloy cylinder is required to be equal to the thickness of the oil-immersed pipe. The metal cylinder 104 is configured to be grounded through the lower flange 114 so that the metal cylinder 104 keeps zero potential, to effectively prevent the transformer coil arranged outside the metal cylinder 104 from being disturbed by partial discharge or electrical particles inside the metal cylinder 104. In summary, the insulated bushing 1000 in this embodiment solves the problems that the transformer pipe in the prior art is difficult to connect and seal, and wastes materials.

Second Embodiment

Figure 3:
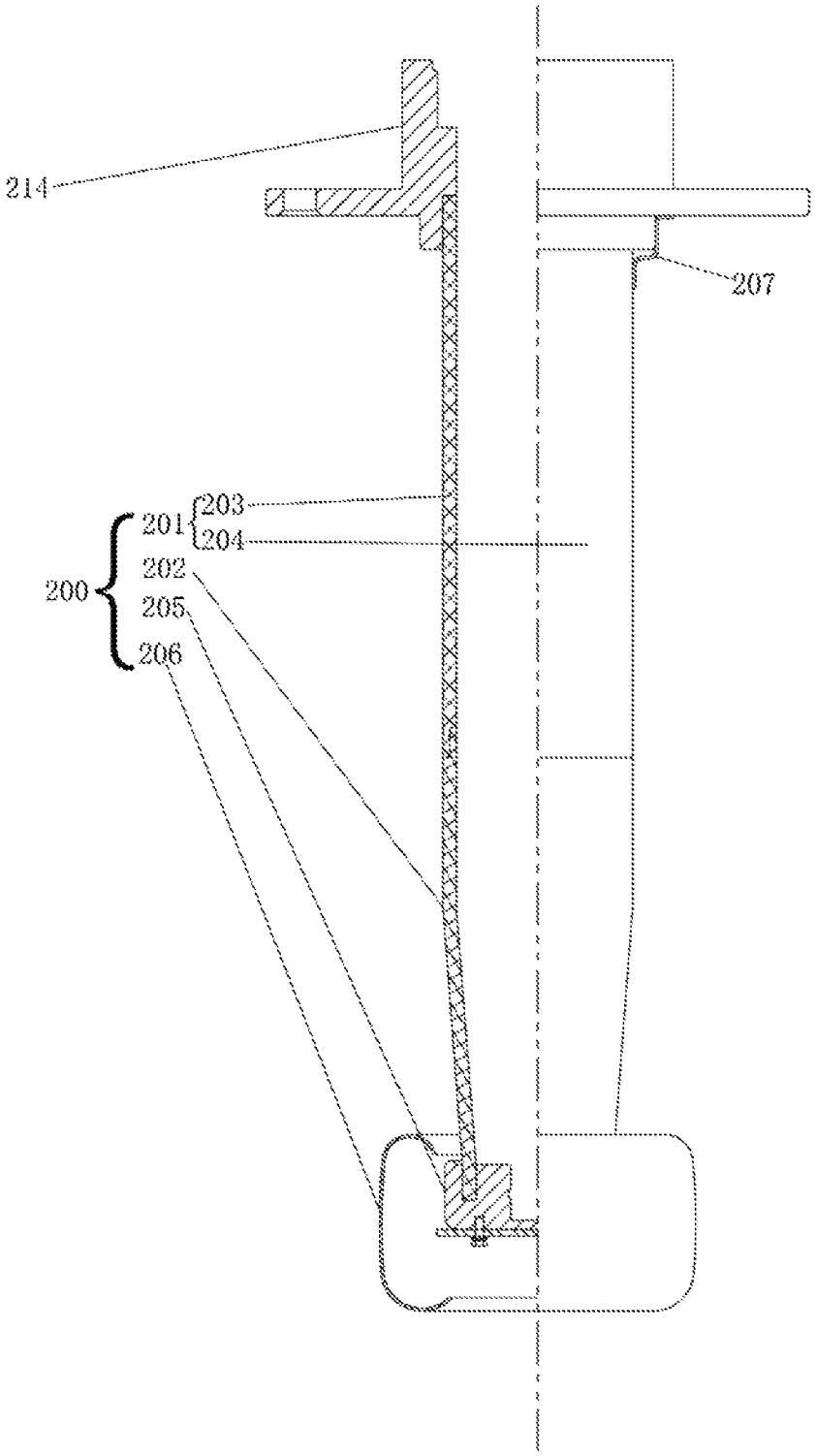
FIG. 3 shows a half-sectional view of an insulated pipe 200 with a lower flange 214 according to a second embodiment of the present disclosure.

As shown in FIG. 3, the insulated pipe 200 in this embodiment includes a upper transformer pipe 201 and a lower oil-immersed pipe 202. The transformer pipe 201 includes an inner pipe 203 and conductive paint 204 coating outside the inner pipe 203. A lower end of the oil-immersed pipe 202 is connected to a lower terminal 205, and a voltage equalizing ball 206 is arranged outside the lower terminal 205.

Both of the inner pipe 203 and the oil-immersed pipe 202 are made of a glass fiber reinforced plastic material, and the inner pipe 203 and the oil-immersed pipe 202 in this embodiment are molded by epoxy resin-impregnated glass fiber winding. In addition, both of the inner pipe 203 and the oil-immersed pipe 202 may also be molded by die casting or other appropriate molding processes. An upper end of the inner pipe 203 is connected to the lower flange 214 in a bonding manner, and a lower end is connected to the oil-immersed pipe 202 in a bonding manner. A lower end of the oil-immersed pipe 202 is connected to the lower terminal 205 in a bonding manner.

The conductive layer in this embodiment is conductive paint 204 formed by spraying copper onto an outer surface of the inner pipe 203. In addition, the conductive paint may also be formed by aluminizing, tinning or silvering on the outer surface of the inner pipe 203 and other processes. A wire 207 is provided on an upper portion of the inner pipe 203 to communicate the conductive paint 204 on the surface of the inner pipe 203 with the lower flange 214, and the conductive paint 204 is grounded through the lower flange 214.

The insulated pipe 200 in this embodiment has all advantages of the insulated pipe 100 in the first embodiment. Compared with the insulated pipe 100 in the first embodiment, the inner pipe 203 and the oil-immersed pipe 202 in this embodiment are not molded in one body, but manufactured respectively and then connected together by bonding. Although it results in an additional connection surface required to be sealed such that the sealing performance is relatively not as good as the insulated pipe 100 in the first embodiment, this embodiment reduces the difficulty in manufacture by manufacturing the inner pipe 203 and the oil-immersed pipe 202 separately, especially by wet winding manner. In addition, the separately designed inner pipe 203 and oil-immersed pipe 202 facilitates the assembly of the members such as conductor and capacitor core in the insulated bushing 2000. Further, the conductive layer outside the inner pipe 203 in this embodiment is conductive paint 204. The conductive paint 204 achieves all functions of the metal cylinder 104, and further saves material and reduces material cost relative to the metal cylinder 104 in the first embodiment.

Third Embodiment

Figure 4:
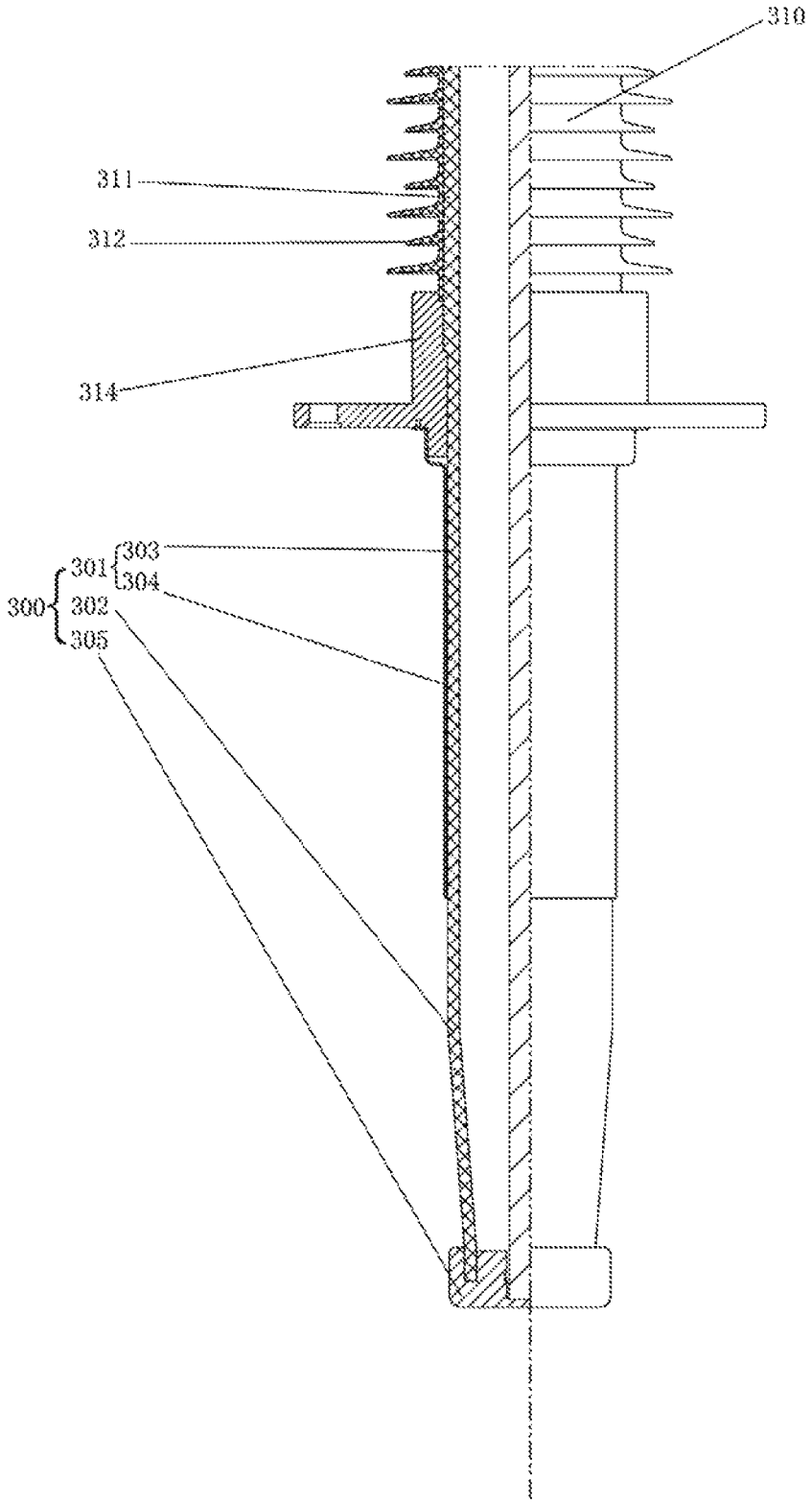

As shown in FIG. 4, the insulated pipe 300 in this embodiment includes a upper transformer pipe 301 and a lower oil-immersed pipe 302. The transformer pipe 301 includes an inner pipe 303 and a metal cylinder 304 outside the inner pipe 303. A lower terminal 305 is connected to a lower end of the oil-immersed pipe 302. The insulated pipe 300 in this embodiment is applied to a device with a low voltage level, thus there may be no voltage equalizing ball arranged outside the lower terminal 305.

An upper end of the insulated pipe 300 is provided with an insulator 310. The insulator 310 includes an inner core cylinder 311, a shed member 312 covering outside the inner core cylinder 311 and a lower flange 314 connected to a lower end of the shed member 312.

The inner core cylinder 311, the inner pipe 303 and the oil-immersed pipe 302 are all molded by epoxy resin-impregnated glass fiber winding, and molded in one body. The lower flange 314 is arranged on a molded glass fiber pipe which is molded in one body, and fastened between the inner core cylinder 311 and the inner pipe 303.

In addition to the description above, the insulated pipe 300 in this embodiment has a substantially same configuration as the insulated pipe 100 in the first embodiment.

For the insulated pipe 300 in this embodiment, the inner core cylinder 311, the inner pipe 303 and the oil-immersed pipe 302 are molded in one body, so there is no requirement on connecting them in the subsequent assembling process, or providing any sealing structure. Since the inner core cylinder 311, the inner pipe 303 and the oil-immersed pipe 302 are molded in one body, the problem of poor sealing can be completely avoided, and the integrity of the insulated bushing can be improved to avoid the mounting positions between these components from being damaged by an external force. In addition, the insulated pipe 300 has all advantages of the insulated pipe 100 in the first embodiment. Further, there is no voltage equalizing ball provided at the lower end of the insulated pipe 300 in this embodiment, thus the insulated pipe 300 in the embodiment can be applied as a lead-out bushings for a low voltage level device. The insulated pipe 300 in this embodiment is also adapted for a high voltage level device.

In the above embodiments, the oil conservator and the upper flange are arranged separately, but it should be noted that the oil conservator and the upper flange can be molded in one body, and the upper end of the shed member is connected to the oil conservator directly.

Although the above embodiments only describe the cases with the composite insulator, but it should be noted that those skilled in the art can naturally conceive that the insulator in the present disclosure may also be a porcelain insulator or an insulator made of other materials according to the description of the embodiments in the present disclosure.

One of ordinary skill in the art would appreciate that variations and improvements to the above configurations and materials may be made, including combinations of technical features revealed or protected individually here, and including other combinations of these features. These variations and/or combinations all fall within the technical field to which the present disclosure relates and fall within the protection scope of claims of the present disclosure.

What is claimed is:

1. An insulated pipe, used for an insulated bushing, the insulated bushing comprising:

an insulator including an intermediate shed member and a lower flange arranged at a lower end of the shed member;

a head member, including an oil conservator connected to an upper end of the insulator and a connecting terminal connected to the oil conservator; and the insulated pipe, connected to the lower flange, the insulated pipe including a upper transformer pipe and a lower oil-immersed pipe, wherein the upper transformer pipe includes an inner pipe, and a conductive layer arranged outside the inner pipe and configured to be grounded through the lower flange via a connection member at the upper end of conductive layer, wherein the connection member has a shape fitting a shape of a lower end of the lower flange, wherein an end of the connection member fits with an outer surface of the lower flange and is connected fixedly to the lower flange.

2. The insulated pipe according to claim 1, wherein the inner pipe and the oil-immersed pipe are molded in one body.

3. The insulated pipe according to claim 1, wherein the inner pipe and the oil-immersed pipe are molded by means of fiber winding.

4. The insulated pipe according to claim 3, wherein the insulator further includes an inner core cylinder supporting the shed member, the inner core cylinder is molded by fiber winding, and the inner core cylinder and the inner pipe are molded in one body.

5. The insulated pipe according to claim 1, wherein the conductive layer is a metal cylinder.

6. The insulated pipe according to claim 1, wherein the conductive layer is conductive paint coated on an outer surface of the inner pipe.

7. The insulated pipe according to claim 1, wherein the insulated pipe is provided with an inside liner inside the insulated pipe.

8. The insulated pipe according to claim 1, wherein an outer surface of the insulated pipe is coated with insulating paint.

9. An insulated bushing, comprising:

an insulator, including an intermediate shed member and a lower flange arranged at a lower end of the shed member;

a head member, including an oil conservator connected to an upper end of the insulator and a connecting terminal connected to the oil conservator; and an insulated pipe, connected to the lower flange, wherein the insulated pipe is an insulated pipe according to claim 1.

* * * * *